US007951023B2

(12) United States Patent
Perkins, Jr.

(10) Patent No.: US 7,951,023 B2
(45) Date of Patent: May 31, 2011

(54) ARCHERY BROADHEAD HAVING BLADE CUT-OUT AND METHOD FOR MAKING SAME

(75) Inventor: Derrick Perkins, Jr., Wolfeboro, NH (US)

(73) Assignee: Liberty Research Co., Gonic, NH (US)

( * ) Notice: Subject to any disclaimer, the term of this patent is extended or adjusted under 35 U.S.C. 154(b) by 688 days.

(21) Appl. No.: 11/937,253

(22) Filed: Nov. 8, 2007

(65) Prior Publication Data

US 2009/0124438 A1 May 14, 2009

(51) Int. Cl.
*F42B 6/08* (2006.01)

(52) U.S. Cl. ..... 473/583; 473/584

(58) Field of Classification Search ..... 473/583, 473/584; 30/346.61, 351
See application file for complete search history.

(56) References Cited

U.S. PATENT DOCUMENTS

| | | | | |
|---|---|---|---|---|
| 2,350,581 | A * | 6/1944 | Boose | 473/583 |
| 2,930,620 | A * | 3/1960 | Brooks | 473/584 |
| 2,940,758 | A | 6/1960 | Richter | |
| 2,993,697 | A | 7/1961 | Urban | |
| 3,064,977 | A * | 11/1962 | Zwickey | 473/582 |
| 4,036,479 | A | 7/1977 | Chaze | |
| 4,036,499 | A | 7/1977 | Sherwin | |
| 4,146,226 | A | 3/1979 | Sorensen | |
| 4,210,330 | A | 7/1980 | Kosbab | |
| 4,537,404 | A | 8/1985 | Castellano et al. | |
| 4,570,941 | A | 2/1986 | Saunders | |
| 4,781,386 | A | 11/1988 | Armitage | |
| 4,807,889 | A | 2/1989 | Johnson | |
| 5,143,380 | A | 9/1992 | Maleski | |
| D355,468 | S | 2/1995 | Lothe | |
| D355,469 | S | 2/1995 | Lothe | |
| D355,470 | S | 2/1995 | Lothe | |
| 5,390,936 | A | 2/1995 | Westenburg | |
| 5,636,845 | A | 6/1997 | Newnam | |
| 5,636,846 | A | 6/1997 | Tinsley | |
| 6,015,357 | A * | 1/2000 | Rizza | 473/583 |
| 6,045,468 | A | 4/2000 | Tinsley et al. | |
| 6,077,180 | A | 6/2000 | Adams, Jr. | |
| 6,290,903 | B1 | 9/2001 | Grace, Jr. et al. | |
| 6,875,138 | B2 | 4/2005 | Perkins, Sr. | |
| 7,314,419 | B2 * | 1/2008 | Grace et al. | 473/583 |
| 2002/0128096 | A1 | 9/2002 | Muller | |
| 2002/0151393 | A1 | 10/2002 | Liechty | |
| 2005/0288135 | A1 | 12/2005 | Perkins, Sr. | |

OTHER PUBLICATIONS

Supplementary European Search Report for European Application No. EP 03 77 6537, completed Nov. 13, 2007, 3 pgs.
Shuttle T-Lock Broadhead: Launch It!, at http://www.tightpoint.com/t-lock.asp, 2 pages (Copyright 2005).
B-52 Broadhead, at http://www.g5outdoors.com/Products/ProductDetail.aspx?productid=1, 2 pages (Copyright 2004).

* cited by examiner

*Primary Examiner* — John Ricci
(74) *Attorney, Agent, or Firm* — Sterne, Kessler, Goldstein & Fox P.L.L.C.

(57) ABSTRACT

A broadhead comprising a ferrule configured to be mounted on an arrow shaft, and at least two cutting blades, configured to be mounted on the ferrule, each having a penetration limiter formed therein. The at least two cutting blades each have a cutting edge and a cutting tip, and wherein the penetration limiter comprises a cut-out formed in the cutting edge to limit penetration of the broadhead upon impact.

20 Claims, 10 Drawing Sheets

PRIOR ART

PRIOR ART

PRIOR ART

PRIOR ART

PRIOR ART

ARCHERY BROADHEAD HAVING BLADE CUT-OUT AND METHOD FOR MAKING SAME

BACKGROUND OF THE INVENTION

1. Field of the Invention

The present invention generally relates to arrowheads for arrows, particularly to broadhead arrowheads.

2. Related Art

The sport of archery includes activities ranging from target practice to game hunting, and the art of providing arrows suitable for each of such purposes has become highly developed. Archery is a type of leisure activity having a very active following. There is a continual demand in the archery field for improved equipment including arrow shafts, arrowheads (also commonly referred to as a "broadheads"), and the like. Specifically, a need exists for broadheads that are strong and durable. Additionally, such broadheads should have a minimal weight ratio to allow use of heavier blades while minimizing the total weight. Most broadheads are designed to maximize the cutting edges of the blades and provide minimum resistance for maximum penetration.

A great many types of broadheads have been developed, with each designed to serve a particular purpose and having specific operating characteristics. Thus, broadheads specifically intended for hunting large, thick-skinned, heavy-boned game such as bear have been developed. Additionally, heads particularly suitable for hunting large thinner-skinned, lighter-boned game such as deer have been developed. Broadheads have also been developed for hunting fowl, particularly turkey, for hunting squirrels and other small game, and for bow-fishing. When such specially designed broadheads are attached to the arrow shaft in non-releasable fashion, it is necessary for the archer to have a wide range of arrows, some for target shooting, some for hunting larger game, some for smaller game.

Broadheads with interchangeable blades have been proposed in an effort to increase the versatility of the broadhead while economizing in the amount of materials needed for production. Systems typical of this general approach are disclosed in U.S. Pat. No. 2,940,758 to Richter, U.S. Pat. No. 4,036,479 to Sherwin, U.S. Pat. No. 4,146,226 to Sorenson and U.S. Pat. No. 4,210,330 to Kosbab.

One such an broadhead is disclosed in U.S. Pat. No. 6,875,138 (the '138 patent) to D. Perkins, Sr., which is incorporated herein by reference in its entirety. When used to hunt small game and fowl, however, the superior aerodynamics and penetration of the '138 patent's broadhead is actually a disadvantage. The arrow (mounted with the broadhead) can pass through the bird, for example. Even on a direct, fatal hit the energy of the arrow is not sufficiently absorbed by the bird upon impact. The arrow can become lost and bird itself can fly for a limited period to complicate retrieval.

Other broadhead designs include saw-tooth or serrated blades, such as disclosed in U.S. Pat. Nos. 5,390,936, D355,468, D355,469 and D355,470. Such saw-tooth and serrated designs do not materially impact the performance of the broadhead.

Still other designs, including U.S. Pat. No. 5,143,380, teach arrows having penetration limiting members for limiting the penetration of the arrow and broadhead through a target. Such penetration limiting members supplement the blades, and thus, increase the surface area to the broadhead and detract from the aerodynamics of the arrow, resulting in poor flight.

While prior-art proposals have achieved significant acceptance in the trade, there has been a continuing need for broadhead improvement.

SUMMARY OF THE INVENTION

Accordingly, the present invention is related to an improved broadhead capable of stopping in a target, such as small game and fowl, so as to substantially obviate one or more of the disadvantages of prior designs.

The broadhead comprises a ferrule capable of mounting on an arrow shaft and at least two cutting blades, capable of mounting on the ferrule, each having a penetration limiter formed therein. The cutting blades each have a cutting edge and a cutting tip, and the penetration limiter comprises a cut-out formed in the cutting edge to limit penetration of the broadhead upon impact.

In one embodiment, the cut-out creates a gap in a length of the cutting edge, wherein the gap comprises more than about 20% of the length of the cutting edge. Moreover, the cut-out may comprise more than about 10% of a cross-sectional area of the cutting blade. In one embodiment, the cut-out comprises an inner, forward-facing portion that is dull. The inner, forward-facing portion of the cut-out can be flat or curved. The cutting blades can be replaceable or permanently mounted to the ferrule. The cutting blades have a substantially triangular shape with a first edge forming the cutting edge, a second edge forming a mounting edge and a third edge forming a trailing edge, wherein the mounting edge includes a notch separating a flush edge portion from a stepped edged portion, the notch being configured to mate with a locking portion of the ferrule to secure the cutting blade to the ferrule with the stepped edge portion inserted into a longitudinal slot in the ferrule and the flush edge portion abutting a flush edge portion of another of the at least two cutting blades mounted to the ferrule. Moreover, the ferrule has a plurality of slots, such that the at least two cutting blades fit into a respective one of the slots.

In one embodiment, the cutting blades can have opposing forward portions that are separated by a clearance that allows the cutting tips to touch each other upon assembly.

In one embodiment, the broadhead comprises a ferrule capable of mounting on an arrow shaft and at least two cutting blades mounted on the ferrule, wherein each cutting blade has means for reducing its cross sectional area, which limits aerodynamic impact of the broadhead to enhance accuracy.

The invention is further directed to a method for forming a broadhead, comprising forming a ferrule capable of mounting on an arrow shaft, forming at least two cutting blades, capable of mounting on the ferrule, and forming a penetration limiter in each of the cutting blades. The method can further comprise forming each cutting blade with a cutting edge and a cutting tip, and forming the penetration limiter as a cut-out located in the cutting edge to limit penetration of the broadhead upon impact.

In one embodiment, forming the cut-out creates a gap in a length of the cutting edge, wherein the gap comprises more than about 20% of the length of the cutting edge. In one embodiment, forming the cut-out comprises removing more than about 10% of a cross-sectional area of the cutting blade. The method can further comprise forming the cut-out with an inner, forward-facing portion that is dull, flat, and/or curved. In one embodiment, the method can further comprise coupling the cutting blades to the ferrule in their center portions by notches formed therein that mate with a locking portion of the ferrule.

In one embodiment, the method can include forming a plurality of slots in the ferrule, such that the cutting blades fit into a respective one of the slots. Moreover, the cutting blades can be formed/positioned with opposing forward portions that are separated by a clearance to allow the cutting tips to touch each other upon assembly. Alternatively, the method can further comprise permanently mounting the cutting blades to the ferrule.

In one embodiment, the invention is directed to the blade itself, having a penetration limiter in the form of a cut-out in the cutting edge to limit penetration of the broadhead upon impact.

It is to be understood that both the foregoing general description and the following detailed description are exemplary and explanatory and are intended to provide further explanation of the invention as claimed.

BRIEF DESCRIPTION OF THE DRAWINGS/FIGURES

DETAILED DESCRIPTION OF THE INVENTION

Reference will now be made in detail to the preferred embodiments of the present invention, examples of which are illustrated in the accompanying drawings.

The broadhead of the present invention is useful for hunting small game and fowl. A cut-out at the forward, cutting edge of each blade limits penetration and ensures that the arrow does not pass through the bird, for example. Therefore, a much higher percentage of the arrow's kinetic energy is absorbed by the bird, thus killing it before it can fly off.

According to the present invention, a non-trivial portion of the blade surface area is removed so the broadhead flies like a field point (practice tip), and effectively cuts up the bird while prevention pass-through shots.

The size and location of the blade cut-out are designed to enhance flight and reduce penetration on small game and fowl.

Each blade of the broadhead can have a single cut-out or a plurality of cut-outs. Each cut-out includes an inner, forward-facing portion that is dull to limit penetration. This is unlike simple serration or saw like teeth found in conventional designs, since such conventional blade adaptations do not function to limit penetration or enhance flight of the broadhead.

Figure 2:
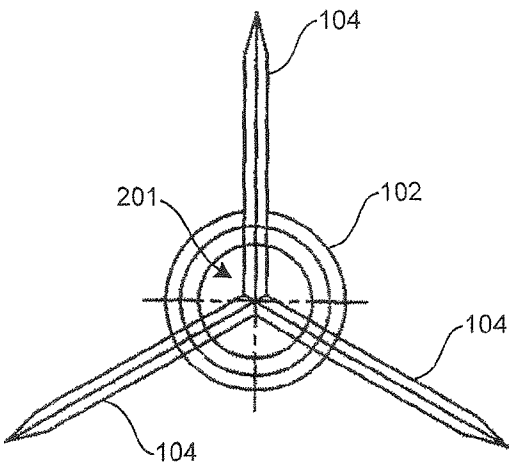
FIG. 2 PRIOR ART
FIG. 2 shows a head-on view of the broadhead of FIG. 1A.
Figure 1A:
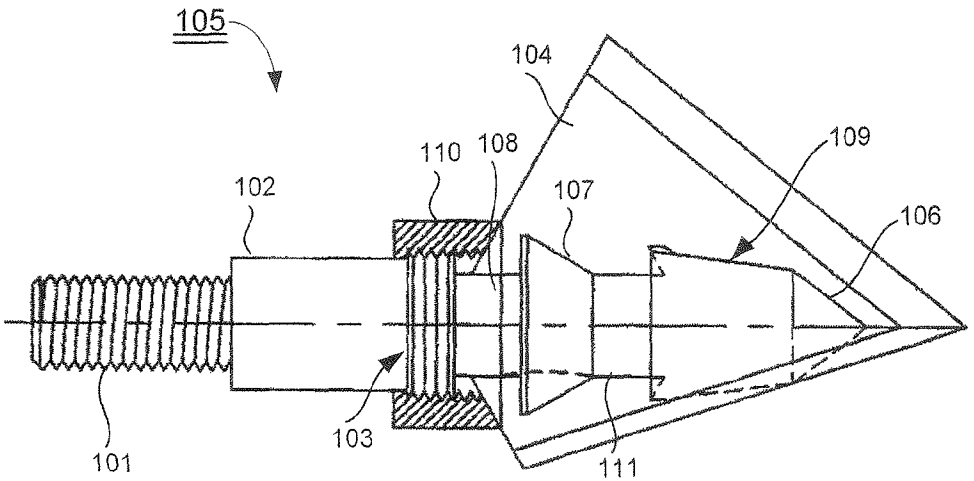
FIGS. 1A and 1B show a side view of an assembled broadhead.

FIG. 1A shows a side view of an assembled broadhead, such as that disclosed in the '138 patent noted above (and sold under the trademark SONIC HEADS®, manufactured by the America Brodhead Company, Gonic, N.H.), and FIG. 2 shows a head on view of the same broadhead. As shown in FIGS. 1A and 2 (generally moving from left to right in FIG. 1A), the broadhead has a mating portion 101 that attaches to an arrowshaft (not shown). A ferrule 105 has a rear body portion 102 with a locking thread 103, on which a locking nut 110 is mounted. The ferrule 105 also has a center cylindrical body portion 108, a flange 107, and a forward cylindrical body portion 111. A conical front portion 109 includes a conical ferrule tip portion 106.

Figure 1B:
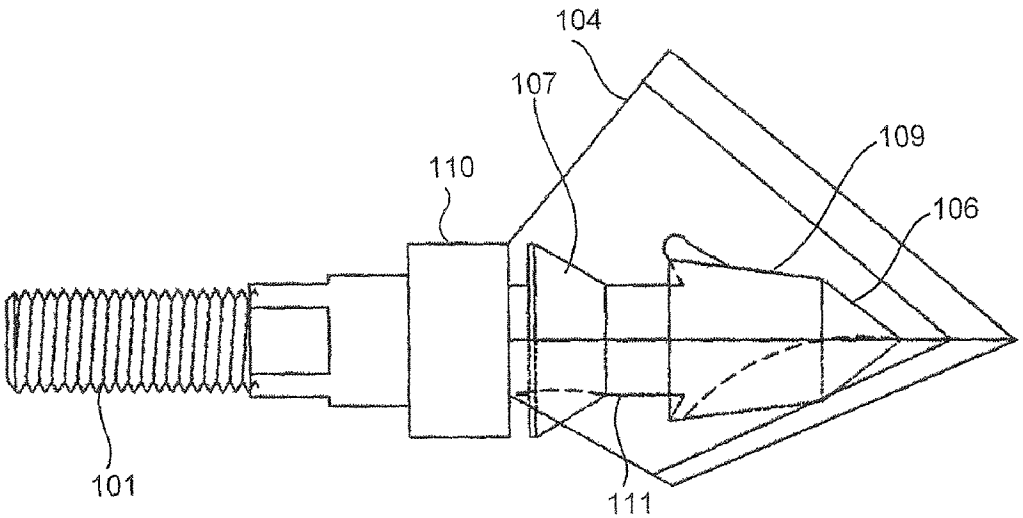

The ferrule 105 also forms the mounting element for blades 104. In the preferred embodiment, three blades 104 are mounted on the ferrule 105, such that upon mounting of the blades 104, the locking nut 110 is used to tighten the blades 104 in place on the ferrule 105. FIG. 1B shows another embodiment of the broadhead, with a blade as illustrated in FIG. 5C, discussed below. More that three blades can be used.

Figure 4:
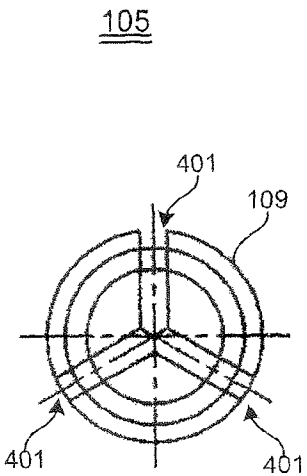
FIG. 4 PRIOR ART
FIG. 4 shows a head-on view of the ferrule of FIG. 3A.
Figure 3A:
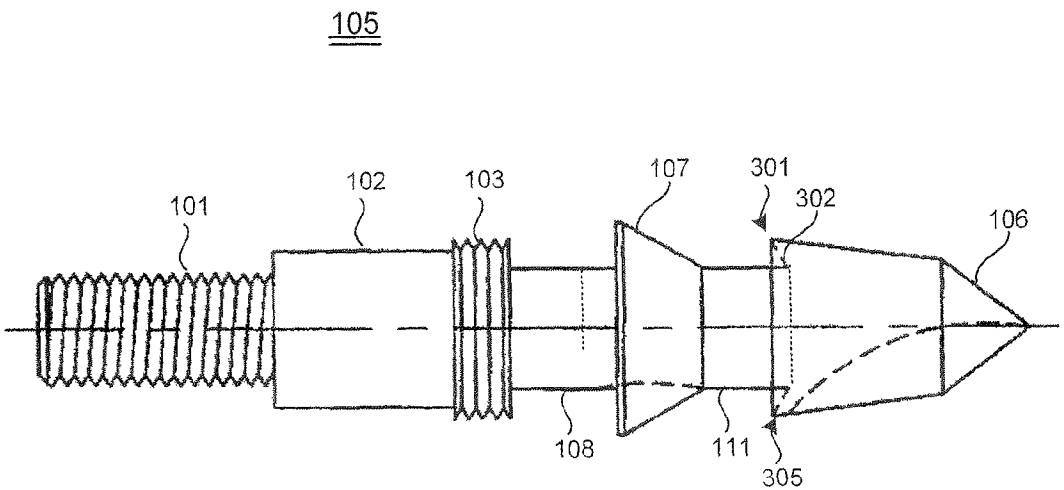
FIGS. 3A and 3B show a detailed view of the ferrule used in the broadhead of FIGS. 1A and 1B, respectively.
Figure 3B:
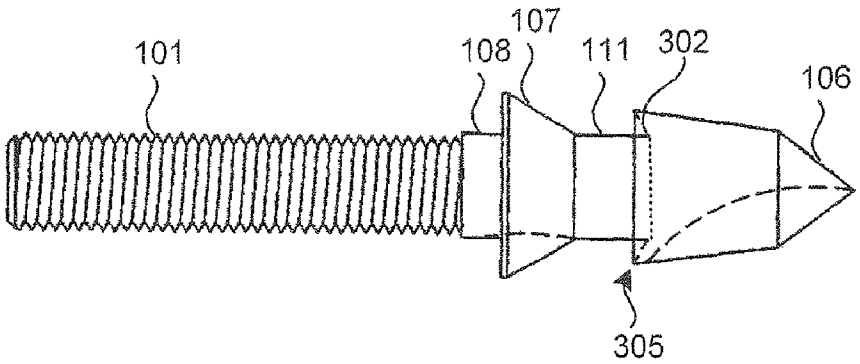

FIG. 3A is a detailed illustration of the ferrule 105. With regard to FIG. 3A, note in particular a recess portion 301, formed by surfaces 302 and an outer surface of the cylindrical body portion 111. The recess portion 301 is used to assist with locking the blades 104 into place by using a locking projection 305. The curved dashed line in FIG. 3A corresponds to a slot 401, shown in FIG. 4, which illustrates a head on view of the ferrule 105. Note in particular the slots 401, each of which receives one blade 104 for mounting on the ferrule 105. FIG. 3B illustrates an alternative embodiment of the ferrule 105, with a smaller center cylindrical body portion 108. This embodiment can be used with the locking nut 110 shown in FIG. 1B and FIGS. 7A-7B (discussed below).

Figure 5A:
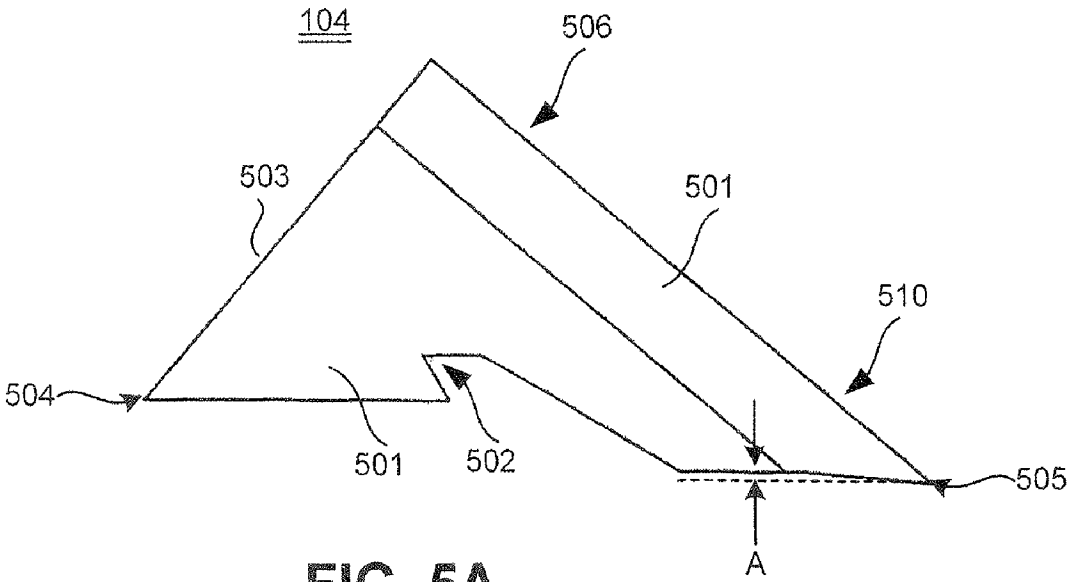
FIGS. 5A-5C show detailed views of broadhead blades of FIGS. 1A and 1B.
Figure 5B:
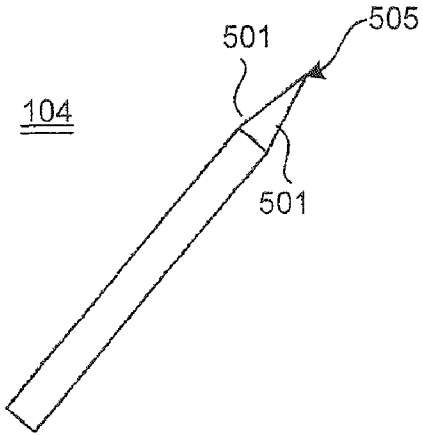
Figure 5C:
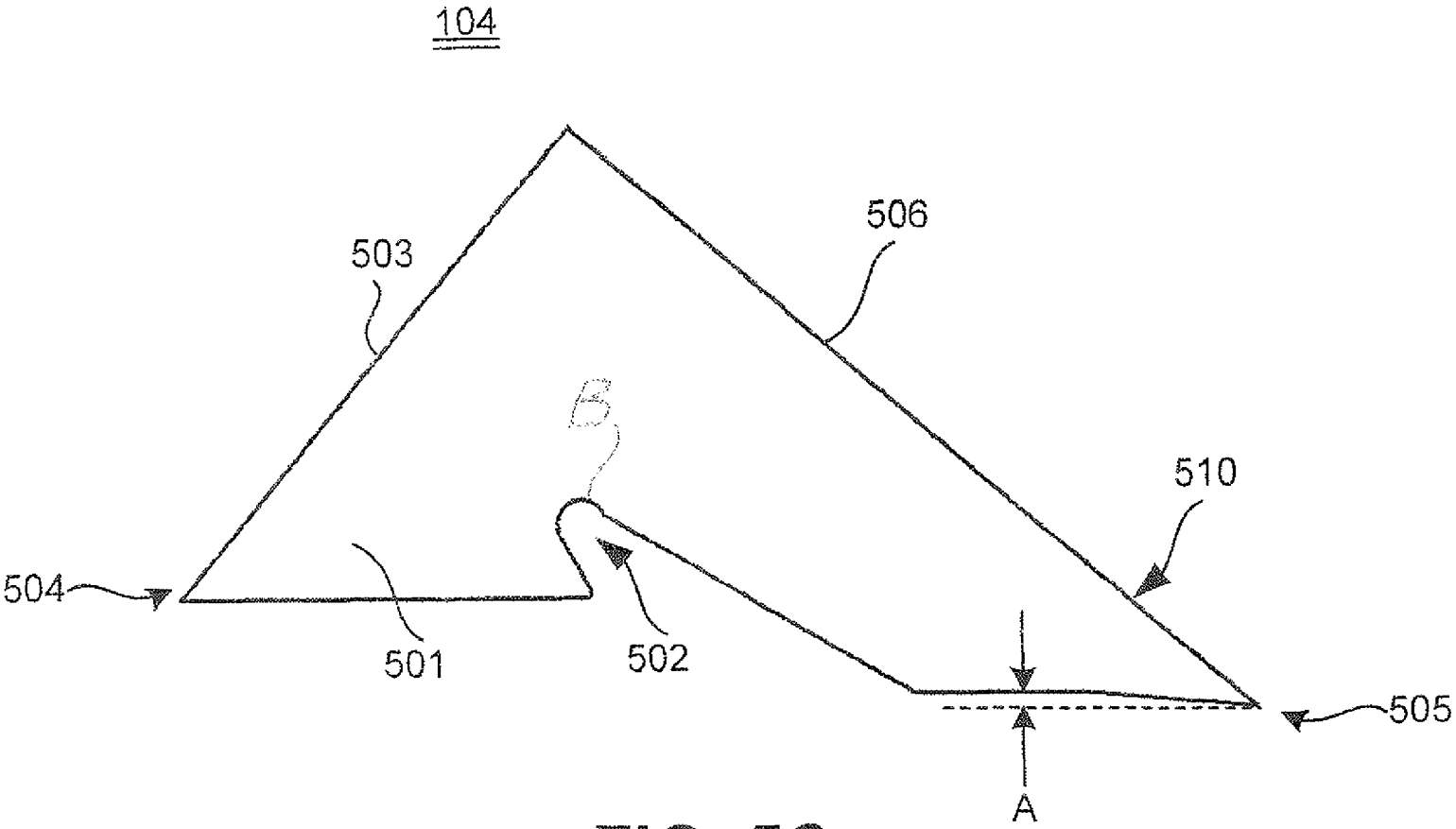

FIGS. 5A-5B are detailed illustrations of the blade 104, showing a side view and an end view, respectively. Note that in this and other figures, the dimensions and angles shown are exemplary only, and should not be viewed as constituting a limitation of the invention. As shown in FIGS. 5A-5B, the blade 104 includes a forward edge surface 501, which is ground to form a razor edge. Furthermore, the blade 104 includes a notch (or recess) portion 502, such that the locking projection 305 and the notch portion 502 mate with surfaces 302, 111, and the recess portion 301 of the ferrule 105. The blade 104 also includes a rear edge 503 (usually not sharpened), a rear locking surface 504 (for coupling to the locking nut 110), a blade edge 506, a forward portion 510 and a forward tip point 505. There may be a clearance at "A," as shown in FIG. 5A, or, alternatively, the forward portion may be beveled at 120° (see location 201 in FIG. 2). FIG. 5C shows another embodiment of the blade 104, with the area "B" of the blade 104 (part of the notch portion 502) having a gradual curvature.

Figure 6:
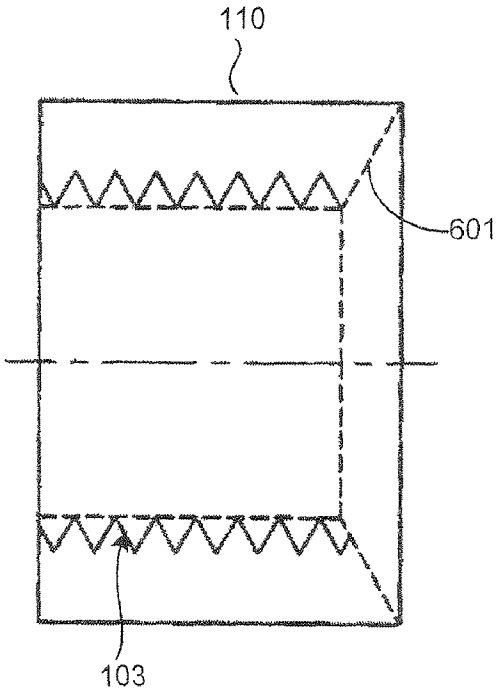
PRIOR ART FIG. 6
FIG. 6 is a detailed view of the locking nut of the broadhead of FIG. 1.

FIG. 6 illustrates the locking nut 110, which preferably has a light straight knurl on its outer surface (not shown in the figures). The locking nut 110 is used to tighten blades 104 on the ferrule 105 once the blades 104 are mounted on the ferrule 105. The locking nut 110 also has an angled portion 601, which abuts the blades 104 when tightened. The angled portion 601 supports the blades 104 when tightened. Rather than a locking nut, other locking devices can be used, such as permanent clamps, reusable clamps, locking rings, or the like locking means.

Further with reference to FIGS. 2 and 5A, in one embodiment, the forward portions 510 of the blades 104 may abut each other, as shown in the center of FIG. 2 (see location 201 in FIG. 2). Each of the blades 104 is machined (beveled) in their forward portions at 120° (or 360° divided by the number of blades in a particular embodiment, if the number of blades is other than three), such that when the three blades 104 are brought together, they abut each other snugly.

The broadhead of the present invention and that of the '138 patent has an advantage of blades that can "cut on impact." The "cut on impact" feature permits the cutting edge of the blades 104 to begin cutting upon impact, compared to a conventional solid tip that secures the tips of the three blades 104. The broadhead of the '138 patent can "lock in" the blades 104 to the ferrule 105 in the middle portion of the ferrule 105 and the blades 104, further enhancing stability and performance of the broadhead. Thus, unlike conventional broadheads that use notches at ends of a ferrule, the '138 patent uses the recess portion 301 in the center portion of the ferrule 105, resulting in a more stable broadhead upon impact.

As noted above, blades 104 support each other during impact due to the 120° beveling arrangement. Furthermore, the broadhead has a locking nut 110 that retains the blade 104 in the ferrule body 105 at the location on the ferrule body 105 shown in FIGS. 1A and 1B. This allows the broadhead to remain assembled even when it is not on the arrow shaft.

Securing the blades 104 at their leading edge tip (such as in conventional designs) may be disadvantageous, because the blade tip is thinner, and thus weaker. Securing the blades 104 at about their mid-section provides for a much more secure fastening technique, since the blades 104 are stronger at that point. In addition to having the spine (forward) portions of the blades 104 beveled at 120°, it is also possible to have the back of the tips be somewhat recessed (see clearance A in FIG. 5A), permitting clearance upon assembly. Individual blades 104 can also be replaced in necessary.

Figure 7A:
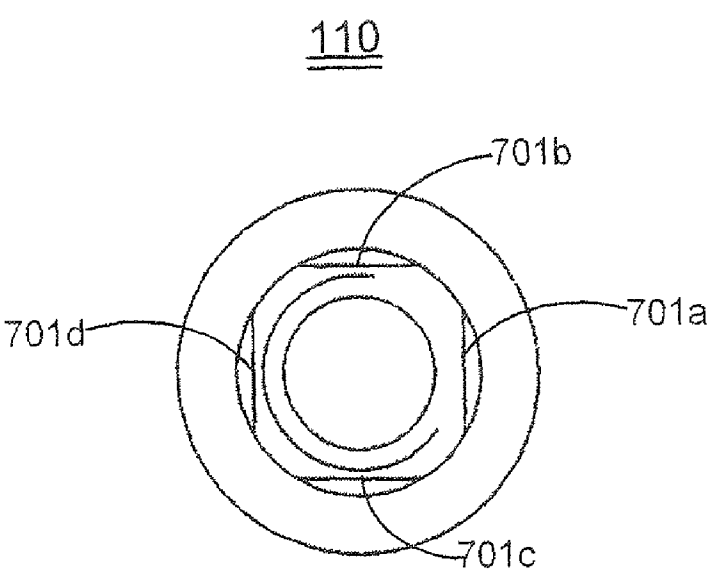
FIGS. 7A and 7B show an alternative embodiment of a locking nut.
Figure 7B:
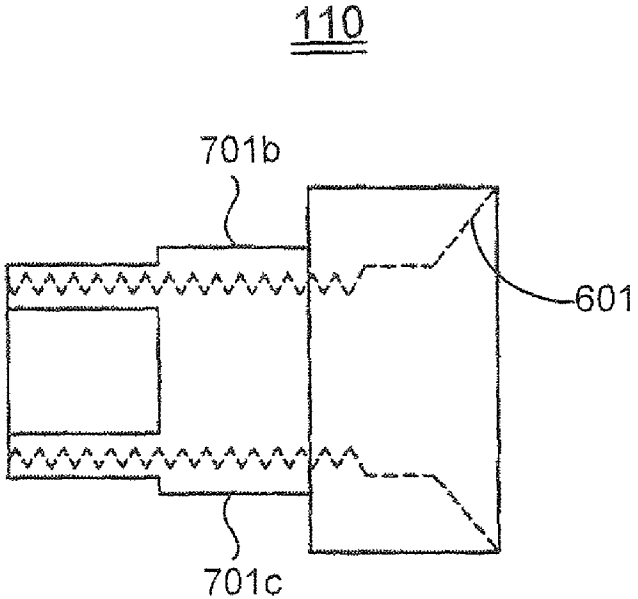
Figure 8:
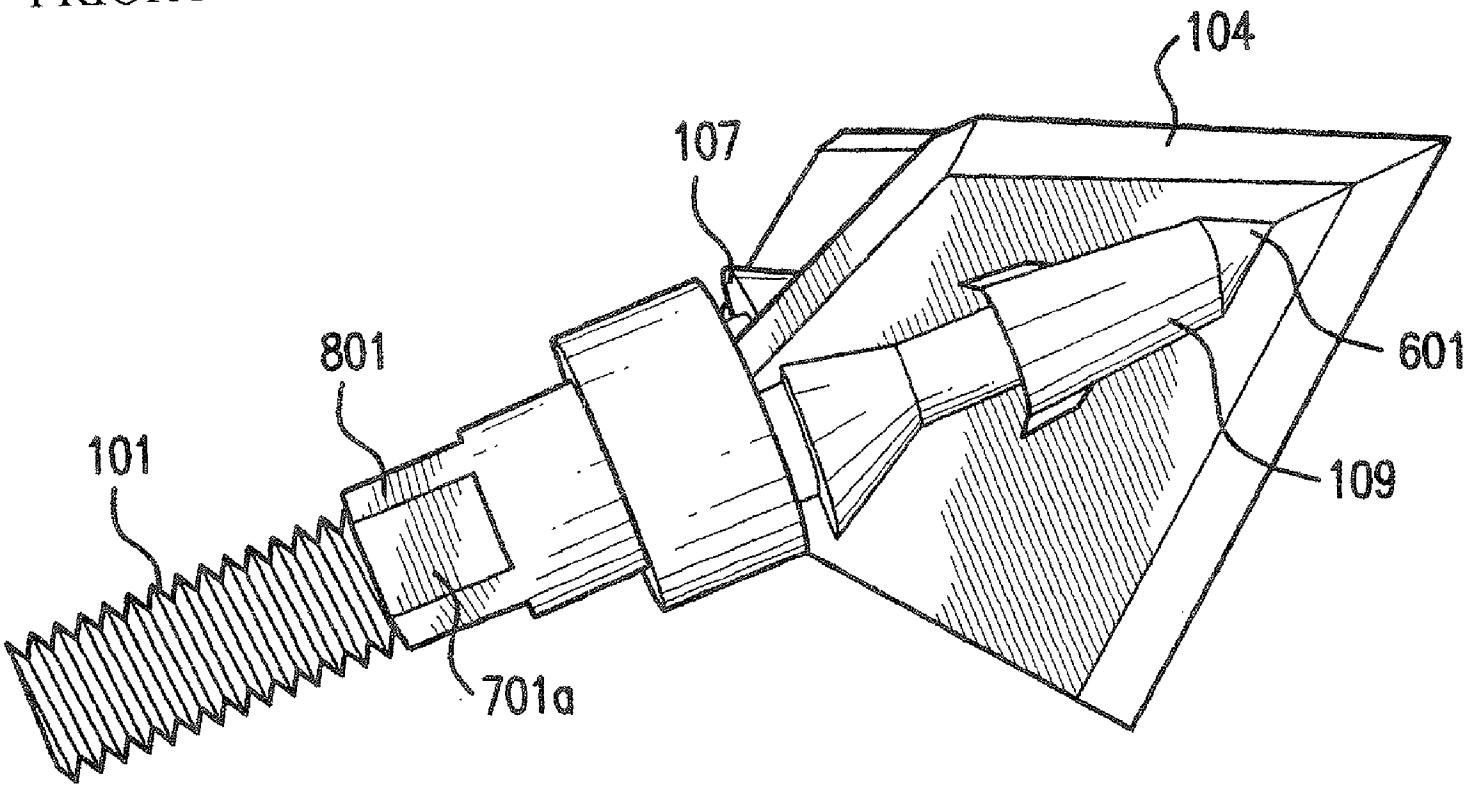
PRIOR ART FIG. 8
FIG. 8 shows a perspective view of the broadhead of FIG. 1B with the locking nut of FIGS. 7A and 7B.

Additionally, as shown in FIGS. 7A and 7B, showing a head-on view, and a side view, respectively, the locking nut 110, instead of having a round cross section with a knurl, can have flat surfaces (e.g., surfaces designated by 701*a*-701*d* in FIGS. 7A and 7B). These surfaces 701*a*-701*d* allow the broadhead to be assembled and tightened by hand prior to its being mated with the arrow shaft. The flat surfaces 701*a*-701*d* preferably have rounded corners (see 801 in FIG. 8, which shows a photograph of one embodiment of the invention), which serve to support the assembled broadhead in the arrow insert in a snug and vibration-free manner. This holds the broadhead more rigidly on the arrow, and does not permit it to move as much.

The blades 104 are usually made of stainless steel, preferably lead-free stainless steel. The nut and ferrule are also preferably made of steel, and preferably lead free steel. Titanium can also be used for any of the elements of the broadhead, including the nut 110, the ferrule 105, and the blades 104. Also, composite materials, or other metals may be used.

A typical manufacturing process for the blades 104 uses stamping and sharpening of the blades 104. The ferrule 105 is typically machined. Other manufacturing processes are possible, e.g., machining the blades 104.

Electroless nickel plating is preferred for the nut 110 and ferrule 105, although additional coatings may be added, such as various friction-reducing (or self-lubricating) coatings, deposited titanium nitride coatings, and TEFLON® coatings. Similarly, the blades 104, or the bolts (not shown in the figures) may be plated with any of the coatings described above as well.

One of the advantages of the present invention and of the '138 patent is that an arrow with the broadhead has the same aerodynamic performance as an arrow with a field point, which is used for practicing. Thus, a shooter does not need to re-sight his bow when switching from practice arrowheads to the broadhead of the present invention.

Arrows using the present invention have been measured moving in excess of 300 feet per second while holding field point accuracy and groupings. Conventional broadheads lose accuracy as speed increases (typically over 250 feet per second), and do not group like field points even at low speeds.

The three blades 104 described above mimic the fletching of the arrow (i.e., the "feather" part on the rear portion of the arrow). This improves the aerodynamic performance of the arrow. The broadhead of the present invention when used at 20 yards and 300 feet per second, results in an accuracy of ¼ inch. Note that the figures have been described in terms of three blades 104, there may be fewer blades (e.g., two), or more blades (e.g., four or more).

Another advantage of the present invention is limited penetrating ability, compared to conventional broadheads.

Figure 9A:
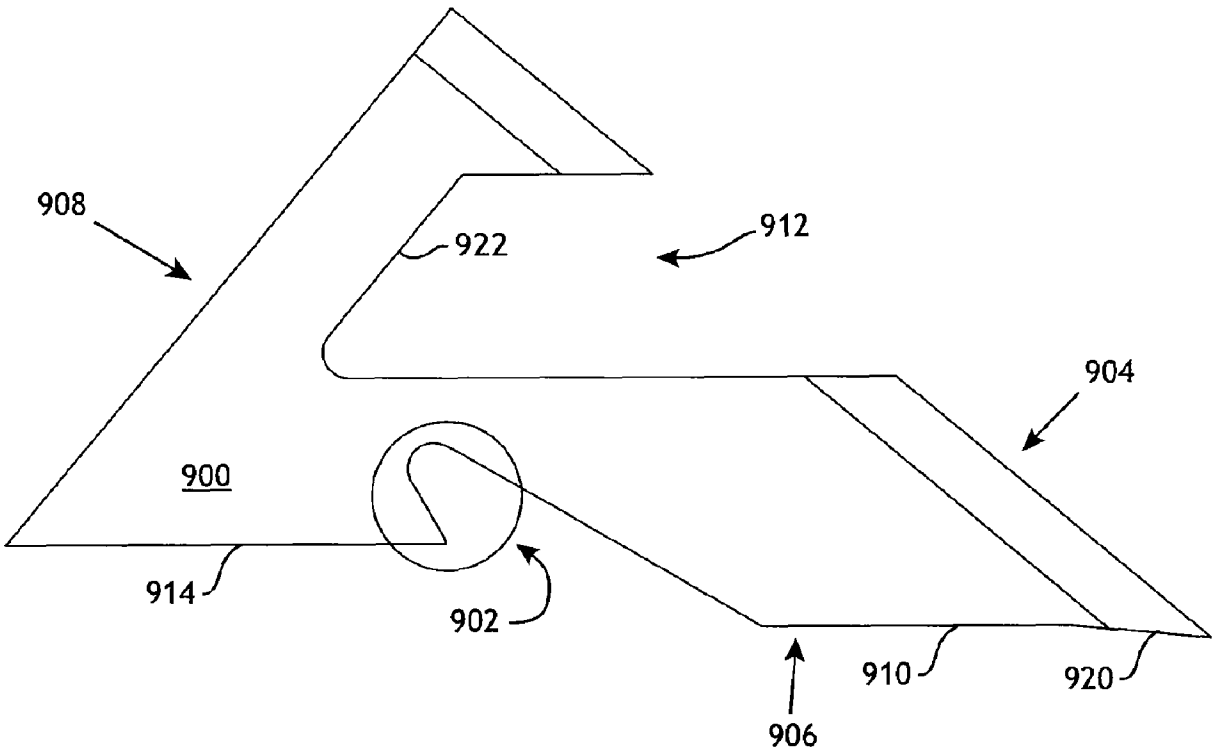
FIG. 9 shows a blade having at least one cut-out to limit penetration, according to an embodiment of the present invention.

FIG. 9 shows a blade 900 with a cut-out 912 according to the present invention. Blade 900, like blade 104, has a substantially triangular shape with a first edge 904 forming the cutting edge (with cutting tip 920), a second edge 906 forming a mounting edge, and a third edge 908 forming a trailing edge. The mounting edge 906 includes a notch 902 (like notch 502) separating a flush edge portion 910 from a stepped edged portion 914. The notch is configured to mate with a locking portion of the ferrule to secure the cutting blade to the ferrule with the stepped edge portion 914 inserted into a longitudinal slot in the ferrule, and the flush edge portion 910 abutting a flush edge portion of at least one other cutting blade mounted to the ferrule.

The cut-outs 912 of the blades function as penetration limiters for the broadhead upon impact. Additionally, the cut-outs act as a means for reducing the cross sectional area of the broadhead, which limits aerodynamic impact of the broadhead to enhance accuracy. Moreover, since the penetration limiters of the present invention are in effect integral with the blades, they are much easier to manufacture and assemble compared to conventional broadhead penetration limiters.

While FIG. 9 illustrates only one cut-out in blade 900, more cut-outs can be used. In one embodiment, the cut-out (or plural cut-outs) create a gap in a length of the cutting edge 904, wherein the gap comprises more than about 5% to 30%, but preferably about 20% of the length of the cutting edge 904. Alternatively, the cut-out 912 may account for than about 5% to 30%, but preferably about 10% of a cross-sectional area of the cutting blade 900. The cut-out comprises an back (i.e., forward-facing) portion 922. In a preferred embodiment, back portion 922 is dull (i.e., not intentionally sharpened like the cutting edge 904).

In one embodiment, the side profile of back portion 922 of the cut-out 912 is straight, but need not be parallel to trailing edge 908. In other embodiments, the back portion 922 can have more than one straight segment, or it can be partially or fully curved, or even comprise combinations of straight and curved segments.

In yet another embodiment the blades can be permanently mounted to the ferrule.

Figure 9B:
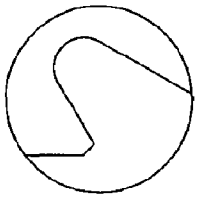

FIG. 9B shows an alternative configuration for notch 902.

The general dimensions of the blade 900 are approximately those of the SONIC HEADS® blades, manufactured by the America Brodhead Company, Gonic, N.H.

While various embodiments of the present invention have been described above, it should be understood that they have been presented by way of example, and not limitation. It will be apparent to persons skilled in the relevant art that various changes in form and detail may be made therein without departing from the spirit and scope of the invention. This is especially true in light of technology and terms within the relevant art(s) that may be later developed. Thus, the present invention should not be limited by any of the above-described exemplary embodiments, but should be defined only in accordance with the following claims and their equivalents.

What is claimed is:

1. A broadhead comprising:

a ferrule configured to be mounted on an arrow shaft; and at least two cutting blades, configured to be mounted on the ferrule, each having a penetration limiter formed therein, wherein each of the at least two cutting blades has a cutting edge and a cutting tip, and wherein the penetration limiter comprises a cut-out formed in the cutting edge and positioned between the cutting tip and a rear portion of the cutting edge to limit penetration of the broadhead upon impact.

2. The broadhead of claim 1, wherein the cut-out creates a gap in a length of the cutting edge, wherein the gap comprises more than about 20% of the length of the cutting edge.

3. The broadhead of claim 1, wherein the cut-out comprises more than about 10% of a cross-sectional area of the cutting blade.

4. The broadhead of claim 1, wherein the cut-out comprises an inner, forward-facing portion that is dull.

5. The broadhead of claim 4, wherein the inner, forward-facing portion of the cut-out is curved.

6. The broadhead of claim 1, wherein the cutting blades are permanently mounted to the ferrule.

7. The broadhead of claim 1, wherein each of the at least two cutting blades has a substantially triangular shape with a first edge forming the cutting edge, a second edge forming a mounting edge and a third edge forming a trailing edge, wherein the mounting edge includes a notch separating a flush edge portion from a stepped edged portion, the notch being configured to mate with a locking portion of the ferrule to secure the cutting blade to the ferrule with the stepped edge portion inserted into a longitudinal slot in the ferrule and the flush edge portion abutting a flush edge portion of another of the at least two cutting blades mounted to the ferrule.

8. A method for forming broadhead, comprising:

forming a ferrule configured to be mounted on an arrow shaft;

forming at least two cutting blades, configured to be mounted on the ferrule, wherein each of the at least two cutting blades has a cutting edge and a cutting tip; and forming a penetration limiter in each of the at least two cutting blades, wherein the penetration limiter comprises a cut-out formed in the cutting edge and positioned between the cutting tip and a rear portion of the cutting edge to limit penetration of the broadhead upon impact.

9. The method of claim 8, wherein forming the cut-out creates a gap in a length of the cutting edge, and wherein the gap comprises more than about 20% of the length of the cutting edge.

10. The method of claim 8, wherein forming the cut-out comprises removing more than about 10% of a cross-sectional area of the cutting blade.

11. The method of claim 8, further comprising forming the cut-out with an inner, forward-facing portion that is dull.

12. The method of claim 11, further comprising forming the inner, forward-facing portion as curved.

13. The method of claim 8, further comprising permanently mounting the at least two cutting blades to the ferrule.

14. The method of claim 8, further comprising coupling the at least two cutting blades to the ferrule in their center portions by notches formed therein that mate with a locking portion of the ferrule.

15. The method of claim 8, forming a plurality of slots in the ferrule, such that the at least two cutting blades fit into a respective one of the slots.

16. A broadhead blade configured to be mounted on an arrow ferrule and having a penetration limiter formed therein, wherein the blade has a cutting edge and a cutting tip, and wherein the penetration limiter has a cut-out formed in the cutting edge and positioned between the cutting tip and a rear portion of the cutting edge to limit penetration of the broadhead upon impact.

17. The blade of claim 16, wherein the cut-out creates a gap in a length of the cutting edge, wherein the gap comprises more than about 20% of the length of the cutting edge.

18. The blade of claim 16, wherein the cut-out comprises more than about 10% of a cross-sectional area of the blade.

19. The blade of claim 16, wherein the cut-out comprises an inner, forward-facing portion that is dull.

20. The blade of claim 19, wherein the inner, forward-facing portion of the cut-out is curved.

* * * * *